United States Patent [19]

Maruyama et al.

[11] Patent Number: 4,497,300

[45] Date of Patent: Feb. 5, 1985

[54] FUEL SUPPLY SYSTEM FOR AN INTERNAL COMBUSTION ENGINE

[75] Inventors: Kimiomi Maruyama, Yokohama; Yasuo Nakajima, Yokosuka, both of Japan

[73] Assignee: Nissan Motor Company, Limited, Yokohama, Japan

[21] Appl. No.: 355,157

[22] Filed: Mar. 5, 1982

Related U.S. Application Data

[63] Continuation of Ser. No. 101,548, Dec. 7, 1979, abandoned.

[30] Foreign Application Priority Data

Dec. 13, 1978 [JP] Japan ..... 53-154479

[51] Int. Cl.[3] ..... F02M 51/06; F02M 55/02

[52] U.S. Cl. ..... 123/463; 123/478

[58] Field of Search ..... 123/458, 463, 472, 478

[56] References Cited

U.S. PATENT DOCUMENTS

| | | | |
|---|---|---|---|
| 2,988,077 | 6/1961 | Hottenroth | 123/465 X |
| 3,596,640 | 8/1971 | Bloomfield | 123/463 X |
| 3,771,507 | 11/1973 | Silvester | 123/463 |
| 3,822,677 | 7/1974 | Reddy | 123/497 |
| 4,034,721 | 7/1977 | Lenzi et al. | 123/463 |
| 4,050,431 | 9/1977 | Jackson | 123/463 X |
| 4,167,169 | 9/1979 | White | 123/458 |
| 4,175,528 | 11/1979 | Mennesson | 123/458 |
| 4,205,377 | 5/1980 | Oyama et al. | 123/489 X |
| 4,216,753 | 8/1980 | Inoue et al. | 123/472 X |

FOREIGN PATENT DOCUMENTS 1331628 9/1973 United Kingdom .

OTHER PUBLICATIONS

"Digitales Hand-Drehzahlmessgeraet", *MTZ Motartechnische Zeitschift,* 38 (1977) 12, pp. 573, 574.

*Primary Examiner*—Parshotam S. Lall
*Assistant Examiner*—W. R. Wolfe
*Attorney, Agent, or Firm*—Schwartz, Jeffery, Schwaab, Mack, Blumenthal & Koch

[57] ABSTRACT

A fuel supply system for an internal combustion engine is disclosed which includes a single fuel injection valve provided at the area at which a plurality of branch passages of an intake manifold join, and a pressure regulator which regulates the pressure of the fuel supplied to the fuel injection valve in accordance with a vacuum pressure in an intake manifold.

According to this system, during low load condition, the pressure of the fuel supplied to the fuel injection valve is held within a range of levels lower than that appearing during high load conditions, thereby increasing the duration during which the fuel injection valve is opened in synchronism with the operation of each cylinder. Thereby, this system makes it possible to uniformly supply fuel to each cylinder for all running conditions of the vehicle.

26 Claims, 6 Drawing Figures

FUEL SUPPLY SYSTEM FOR AN INTERNAL COMBUSTION ENGINE

This is a continuation of application Ser. No. 101,548, filed Dec. 7, 1979 now abandoned.

BACKGROUND OF THE INVENTION

The present invention relates to a fuel supply system for an internal combustion engine, and more particularly to a single point injection type fuel supply system in which a single fuel injection valve is disposed in the area where a plurality of branch passages of an intake manifold join.

In a conventional method, for all running conditions of the engine, the amount of fuel supplied is controlled by varying the pulse width of a signal controlling the electronic fuel injection valve.

However, according to the conventional method, the area of the opening of the fuel injection valve is set such that when the width of the driving pulse corresponding to a valve opening time of the fuel injection valve is maximum, that is, when the valve is substantially held continuously fully opened, the maximum amount of fuel required is supplied. Accordingly, in the range of low air intake conditions, particularly in the extreme case when the engine is idling, an extremely narrow driving pulse corresponding to the valve opening time is required.

In a usual gasoline internal combustion engine for an automotive vehicle, it is required that the maximum amount of fuel supply required per unit of time be approximately forty times or more as large as the amount of fuel supplied at the time of idling. In other words, it is required that the width of the driving pulse corresponding to the valve opening time of the fuel injection valve at the time of idling be approximately one fortieth or less of that at the time when the fuel injection valve is continuously held fully opened.

For instance, in an engine which idles at 600 r.p.m., the time required for each revolution is 0.1 sec, that is, 100 msec. Accordingly, it is required that the width of the driving pulse of the fuel injection valve per each rotation be set to 2.5 msec or smaller as approximately one fortieth of 100 msec.

Meanwhile, the accuracy of the valve opening time of the electromagnetic fuel injection valve depends on time delay inherent in the mechanical operating parts of the fuel injection valve with respect to the driving electronic signal.

The commonly used fuel injection valve requires about 1.6 msec to move from the closed condition of the valve to the opened condition thereof and about 0.9 msec to move from the opened condition of the valve to the closed condition thereof. Accordingly, as best shown in FIG. 1, illustrating the relationship between the amount of fuel injected and driving pulse width, in the operation of fuel injection in which the width of driving pulse is smaller than about 2 msec, extremely large variations in operating time are apt to occur, thereby making it difficult to maintain the desired accuracy of the amount of fuel supply.

FIG. 2 is an operational diagram showing a fuel injection mode with respect to crank angle at the time of idling of an engine with six cylinders according to the conventional fuel injection system.

As seen from FIG. 2, in an engine with the six cylinders, an amount corresponding to one rotation, i.e. fuel for three cylinders e.g. #1, #5, #3 is injected in a single pulse, while in an engine with four cylinders, a single pulse feeds two cylinders. Assuming that the idling speed is 600 r.p.m., the fuel injection time is only about 2.5 msec. Therefore, with the conventional method in which fuel is injected only once per each rotation of the engine, the fuel is unequally supplied to the cylinders. This results in drawbacks such as polluted exhaust and rough idling.

In order to prevent this problem, another method has been proposed to effect fuel injection in synchronism with the intake stroke of each cylinder.

With this method, with six cylinders the time required for effecting one fuel injection is only 0.8–0.9 msec, while with four cylinder it is 1.2–1.3 msec. Accordingly, in practice it is impossible to supply fuel to each cylinder with a high accuracy.

It is further noted that the distribution of fuel being injected to one cylinder is different from another not only at the time of idling but also at the time of low speed or low load in the range of small intake flow, that is, when the amount of fuel being supplied is small.

SUMMARY OF THE INVENTION

With the above in mind, an object of the present invention is to provide a fuel supply system for an internal combustion engine which makes it possible to effect fuel injection according to the load on the engine.

Another object of the present invention is to provide a fuel supply system for an internal combustion engine which makes it possible to maintain good running conditions particularly in the zone of low load.

A further object of the present invention is to provide a fuel supply system for an internal combustion engine which makes it possible to reduce the cost thereof.

A still further object of the present invention is to provide a fuel supply system for an internal combustion engine which makes it possible to uniformly supply fuel to each cylinder.

According to the present invention, there is provided, a fuel supply system for an internal combustion engine comprising; a single fuel injection valve provided at the area at which a plurality of branch passages of an intake manifold join, a pressure regulator which regulates the pressure of the fuel supplied to the fuel injection valve in accordance with a vacuum pressure in an intake manifold, a sensor for detecting cylinder operation, and an electric control circuit which controls the operation of the fuel injection valve in accordance with the output of the sensor.

The system characterized in that, during low load conditions, the pressure of the fuel injection valve is held within a range of levels lower than that appearing during high load conditions, thereby increasing the duration during which the fuel injection valve is opened in synchronism with the operation of each cylinder.

Preferably, a fuel supply system for an internal combustion engine according to the present invention will have an electronic control circuit comprising an intake air flow detecting circuit responsive to an output of an air flow meter, a vacuum pressure detecting circuit responsive to an output of an intake vacuum pressure sensor, a driving pulse width calculating circuit producing a driving pulse responsive to the outputs of the intake air flow detecting circuit and the vacuum pressure detecting circuit, a timing circuit for determining the timing of the fuel injection responsive to a sensor for detecting the operation of each cylinder, and a fuel injection valve driving circuit responsive to the driving pulse and the output of the timing circuit to render the fuel injection valve operative.

Figure 1:
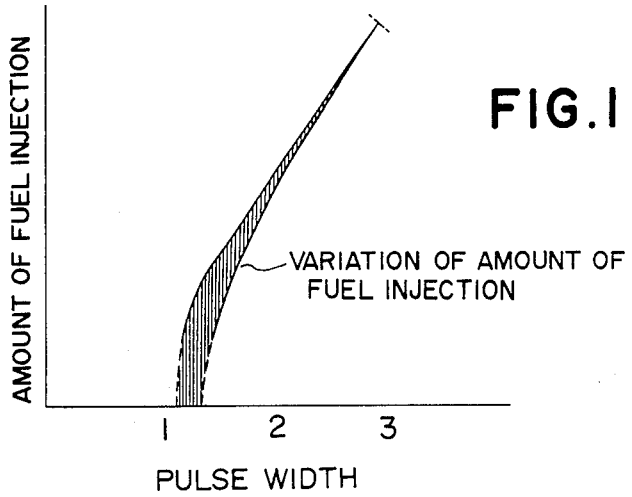
FIG. 1 shows a graph illustrating the relation between pulse width and the amount of fuel injected.
Figure 2:
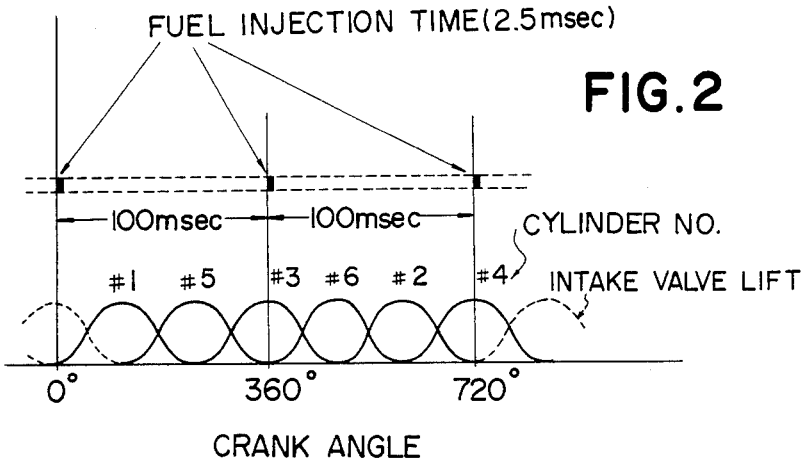
FIG. 2 is an operational diagram showing fuel injection mode with respect to crank angle for an engine with six cylinders when idling, in accordance with a conventional fuel injection method.

In these drawings, any one reference numeral indicates in all figures the same or similar element of the fuel supply system for an internal combustion engine according to the present invention.

DETAILED DESCRIPTION OF THE PREFERRED EMBODIMENTS

Before proceeding to the explanation of the preferred embodiments, reference is first made to the principle of the fuel supply system for an internal combustion engine according to the present invention.

The main feature of the present invention resides in that, in a single point injection type fuel supply system, during low load conditions, the pressure of the fuel injection valve is held within a range of levels lower than that appearing during high load conditions, thereby increasing the duration during which the fuel injection valve is opened in synchronism with the operation of each cylinder.

Figure 3:
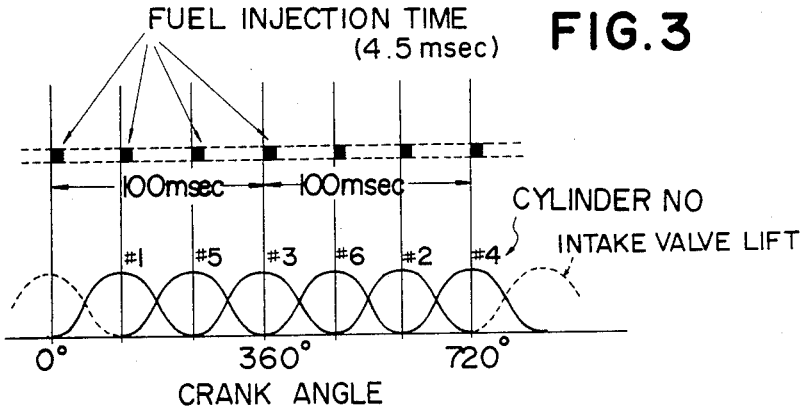
FIG. 3 is an operational diagram similar to FIG. 2 according to the present invention.

FIG. 3 is an operational diagram showing fuel injection mode with respect to crank angle at the time of idling in an engine with six cylinders in accordance with the fuel injection method of the invention. Referring to FIG. 3, for instance, assuming that the pressure of the fuel being supplied to a fuel injection valve is set to a value equal to or less than, one fifth of that at the time of maximum fuel supply required. Even if fuel is injected at the intake stroke of each cylinder the time required for each injection is above 4–5 msec in the case of six cylinders. With four cylinders, however, the time required for each injection is above 6–8 msec. Thus, the fuel supply method employed in the present invention makes it possible to improve the accuracy of the amount of fuel being injected from the fuel injection valve to an intake manifold.

Figure 4:
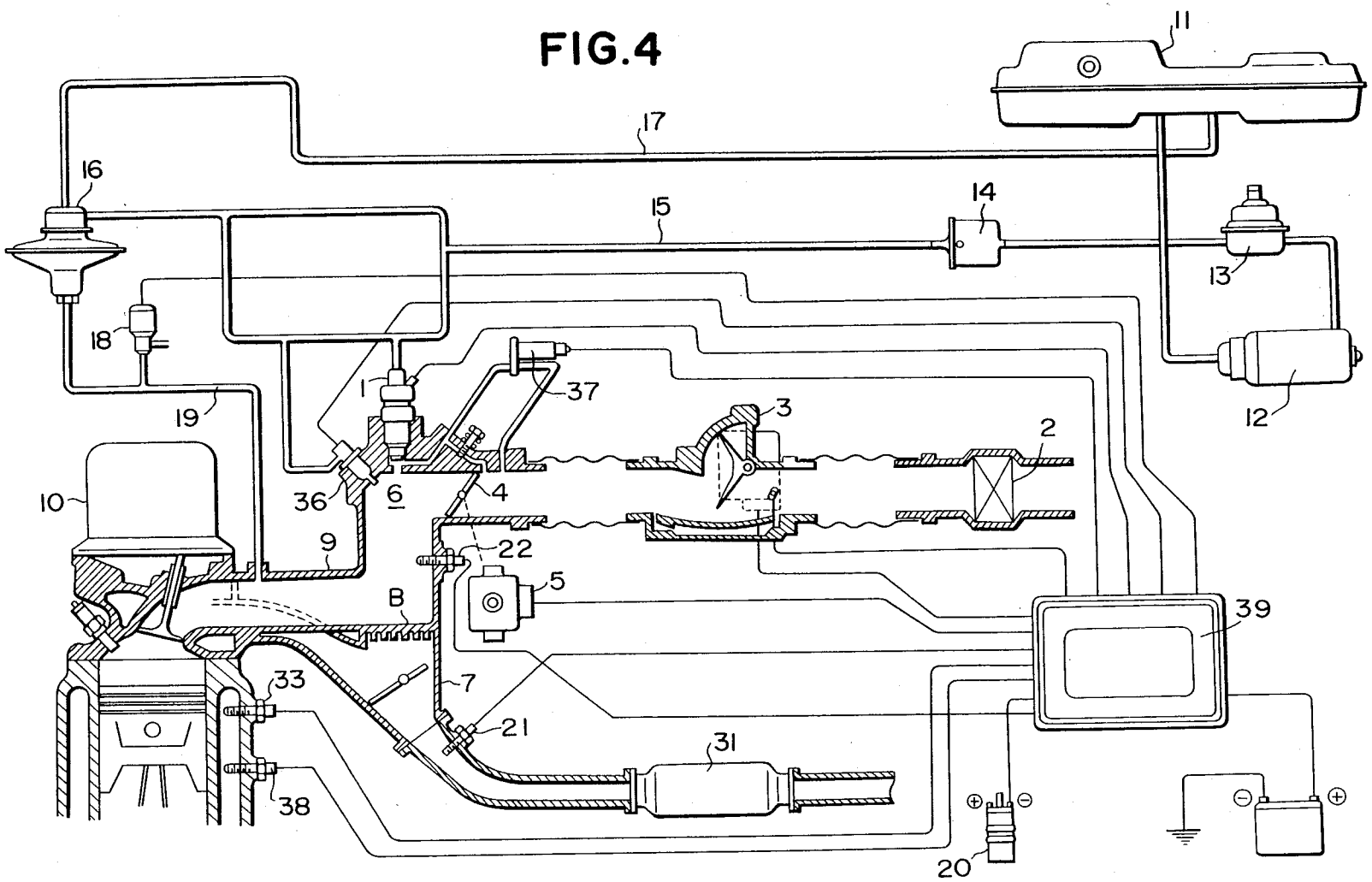
FIG. 4 is a diagrammatical view of a fuel supply system according to the present invention.

FIG. 4 shows an embodiment of an internal combustion engine in which the single point injection system is employed according to the present invention.

Reference numeral 1 denotes a fuel injection valve disposed downstream of a throttle valve 4 provided within an air intake manifold 6 for taking in air through an air cleaner 2 and an air flow meter 3. The fuel injection valve 1 is disposed so that a downward injection opening thereof faces riser portion B provided at the area at which a plurality of branch passages 9 of an intake manifold 6 join. The intake manifold 6 is adjacent to an exhaust manifold 7 to effect heat exchange, thereby promoting the atomization of fuel.

The fuel injection valve 1 is formed with an opening at the exit thereof. The intake manifold 6 branches downstream thereof and is connected with each cylinder of an engine 10.

It is to be noted that the fuel injection valve is disposed so that the fuel being injected into the intake manifold 6 is supplied in the center of the suction air stream so that the atomization of the fuel is sufficient to make the mixture homogenous. This makes it possible to promote the fuel distribution to each cylinders.

The fuel is supplied from a fuel tank 11 through a fuel pump 12, a fuel damper 13, a fuel strainer 14 and a fuel conduit 15. A pressure regulating device 16 is connected at a first inlet port to the fuel conduit 15 and at an outlet port to a fuel return pipe 17 for returning extra fuel to the fuel tank 11. Thus, the pressure of the fuel being supplied to the fuel injection valve is controlled at some predetermined value.

The pressure regulating device 16 is connected at a second inlet port to a vacuum pressure pipe 19 for introducing a vacuum from the intake manifold 6. An electromagnetic valve 18 is disposed in the intermediate portion of the vacuum pressure pipe 19. The pressure regulating device 16 is constituted so that the pressure of the fuel supplied thereto can be adjusted by the vacuum pressure within the intake manifold 6.

Figure 5:
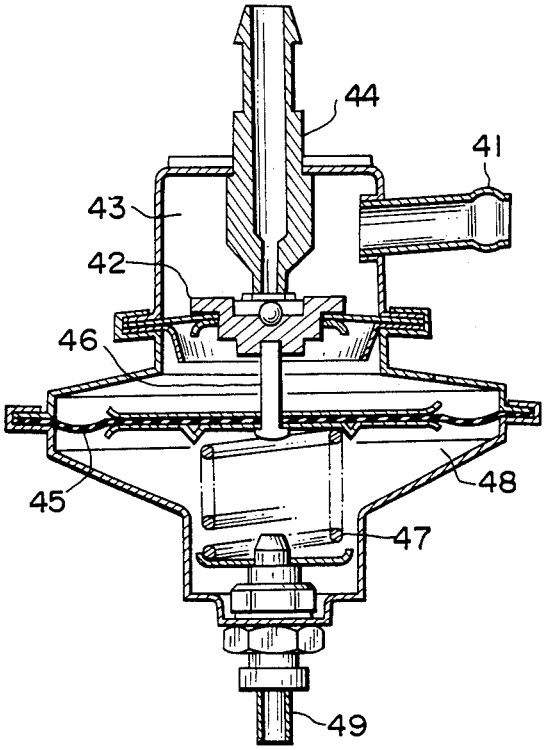
FIG. 5 is a longitudinal cross sectional view illustrating the pressure regulating device shown in FIG. 4.

Reference is now made to the detailed construction of the pressure regulating device 16 with reference to FIG. 5.

The pressure regulator 16 comprises; a fuel inlet nozzle 41 one end of which communicates with a fuel pump 11 described below, while the other end communicates with a fuel chamber 43, a fuel outlet nozzle 44 provided through one end of the fuel chamber 43, one end of which communicates with a return passage 17 of the fuel pump, while the other end comes in contact with a valve member 42 provided within the fuel chamber 43, a stem portion 46 connecting the valve member 42 and the diaphragm member 45, a compression spring 47 disposed between the lower surface of the diaphragm member 45 and the bottom of the vacuum chamber 48, and a vacuum pressure conduit nozzle 49 provided through the bottom of the vacuum chamber 48, which communicates with the intake manifold 6.

It is to be noted that the valve member 42 has a cross sectional area smaller than that of the diaphragm 45. Thus, it is possible to lower the pressure of the fuel supplied to the fuel injection valve 1, particularly during low load conditions. When the pressure of the fuel is below the predetermined value, a fuel exit nozzle 44 is closed by the valve member 42, thereby stopping the supply of the fuel to the fuel exit nozzle 44. On the other hand, when the pressure of the fuel being supplied from the entrance nozzle 41 is above the predetermined value, the valve member 42 connected to the diaphragm member 45 through the stem 46 lowers against the compression spring 47, thereby producing a gap between the fuel nozzle 44 and the valve member 42. The fuel is thus drained through the fuel exit nozzle 44.

When the fuel within the fuel chamber 43 is drained via the fuel exit nozzle 44, the pressure of the fuel within the fuel chamber 43 is temporarily lowered. As a result, when the pressure is below the predetermined value, the valve member 42 moves upwards by the force of the spring to close the fuel exit nozzle 44 thereby stopping fuel return to the fuel tank 11.

Thus, the pressure of the fuel within the fuel chamber 43, that is, the pressure of the fuel upstream of the fuel entrance nozzle 41 is controlled by repeated operation of the valve member 42.

A vacuum pressure nozzle 49 for introducing a vacuum pressure which communicates with the vacuum chamber 48, is connected to the intake manifold 6. The pressure regulating device 16 is constituted so that the pressure of the fuel is controlled in accordance with the vacuum fluctuations of the intake manifold 6. The pressure regulating device 16 allows a pressure range from, for instance, 0.7–0.8 kg/cm$^2$ to 4 kg/cm$^2$.

On the other hand, with a conventional fuel supply system in which an injection fuel valve is provided for each cylinder, the pressure difference between the pressure of the fuel supplied from the fuel pump and the pressure of the fuel regulated by the pressure regulating device is constant. The range of the difference is from 2.5 to 1.8 kg/cm$^2$.

Referring to FIG. 4, an electronic control device 39 has a plurality of input terminals and output terminals:

Each input terminal is connected to an air flow meter 3 which senses the intake air flow rate to produce an output signal in accordance with the air flow detected, an oxygen sensor 21 for detecting oxygen in the exhaust, a sensor 22 for measuring intake vacuum within the intake manifold 6 positioned downstream of the throttle valve 4. A water temperature 33 for sensing the temperature in the engine 10, a thermo time switch 38 for sensing the temperature during cold condition to become operative in response to the predetermined temperature, and an ignition coil 20 which is energized by an ignition pulse in order to effect fuel injection in synchronism with the operation of each cylinder;

Each output terminal is connected to the solenoid-operated injection valve 1, a throttle position switch 5 for controlling the opening positions of the throttle valve 4, an electromagnetic valve 18, and a cold-start valve 36.

In place of detecting an intake air flow rate with the air flow meter 3, it is sufficient to detect an intake air flow rate due to the opening of the throttle valve 4 or the intake vacuum pressure at a position downstream of the throttle valve. A Carman voltex flow meter or hot wire type flow meter may be used.

Figure 6:
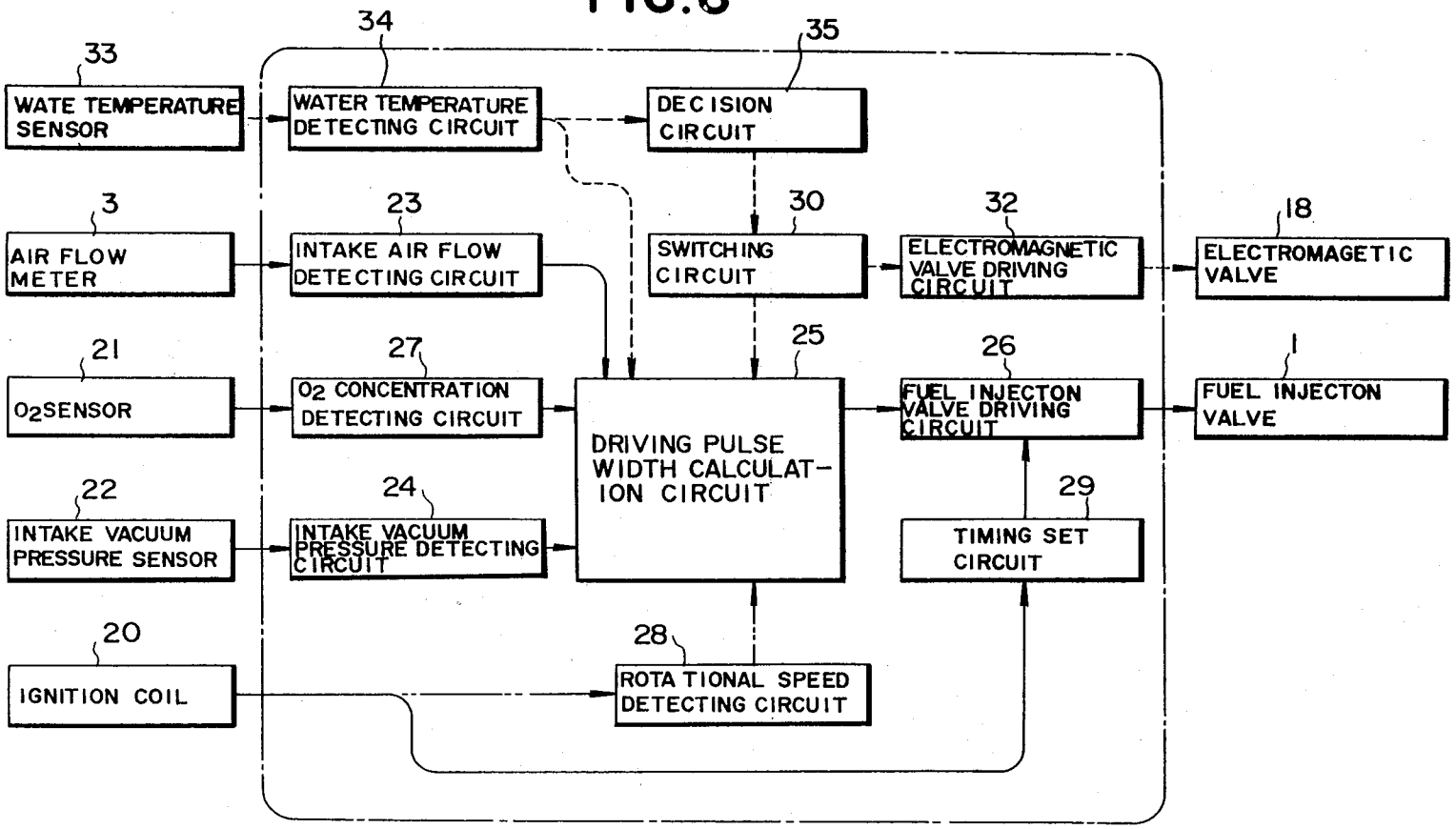
FIG. 6 is a block diagram of the control circuit shown in FIG. 4.

FIG. 6 shows a diagramatical view illustrating details of the electronic control device 39 and components associated therewith.

Reference numeral 23 denotes an intake air flow detecting circuit to which an output signal from the air flow meter 3 is inputted. Reference numeral 24 denotes an intake vacuum detecting circuit to which an output signal from the intake vacuum sensor 22 is inputted. The output of the intake air flow detecting circuit 23 is inputted to a driving pulse width calculation circuit 25 which produces an output for determining the amount of the fuel supply of the fuel injection valve 1. The driving pulse width calculation circuit 25 is connected to the fuel injection valve 1 through a fuel injection valve driving circuit 26. Thus, the fuel injection valve 1 is controlled so as to supply an amount of fuel appropriate to a given intake air flow. An oxygen concentration detecting circuit 27 to which an output signal of the oxygen sensor 21 is inputted is connected to the driving pulse width calculating circuit 25. The pulse width set in the circuit 25 is corrected in accordance with the output of the oxygen concentration detecting circuit 27, thereby making it possible to effect a correction advantageous to the exhausting purify system in which a catalyst device 31 for removing undesirable gaseous components, such as NOx, CO, HC is provided in the exhaust system.

A circuit 29 for setting a fuel injection valve operating timing in accordance with an output signal being supplied from an ignition coil 20 is connected to a fuel injection valve driving circuit 26. The fuel injection valve 1 is opened in synchronism with the operation of each cylinder to inject a predetermined amount of fuel.

In the above embodiment, the amount of fuel injection is determined in accordance with the intake air flow detected by air flow meter 3. However, instead of using the air flow meter 3, it is possible to effect fuel supply control by the detected value of the rotational speed of the engine. In order to use this, in place of the air flow meter 3 and the intake air flow detecting circuit 23, as shown by a broken line in FIG. 6, it is sufficient to provide a detecting circuit 28 for detecting the rotational speed of the engine, which is connected to the driving pulse width calculating circuit 25. In this case, the driving pulse width is determined in accordance with the outputs of the circuit 28 for detecting the rotational speed of the engine and the circuit 24 for detecting intake vacuum pressure.

The fuel supply system according to the present invention makes it possible to set the driving pulse width of the fuel injection valve 1 to be substantially constant by controlling the pressure of the fuel being supplied to the fuel injection valve according to the fluctuation of the intake vacuum pressure.

It is further noted that the fuel supply system according to the present invention makes it possible to increase the amount of injected fuel by elevating the pressure of the fuel being supplied to the fuel injection valve 1 at the time of a cold start.

To do this, the fuel supply system according to the present invention further comprises a sensor 33 for detecting water temperature, a water temperature detecting circuit 34 which processes the output of the sensor 33, a decision circuit 35 which judges whether the water temperature is above the predetermined value to produce an output signal in accordance with the result of the decision, a switching circuit 30 responsive to the output of the decision circuit 35, and an electromagnetic driving circuit 32 responsive to the output of the switching circuit 30 to make the electromagnetic valve 18 operative. The outputs of the water temperature detecting circuit 34 and the switching circuit 30 are supplied to the driving pulse width calculating circuit 25.

With this circuit construction, during the cold start operation, the electromagnetic valve 18 becomes operative to introduce air into the vacuum pipe 19, thereby setting the pressure within the fuel conduit 15 higher than that at the time of idling. Thus, the driving pulse width is corrected in accordance with the water temperature.

It is to be noted that it is possible to effect an increase in fuel by correcting the driving pulse width of the fuel injection valve 1 without the provision of the electromagnetic valve 18. In this case, the provision of the cold start valve is not required.

An exhaust recirculation control device may be provided to purify the exhaust.

It is further noted that, in place of an output from the ignition coil, it is sufficient to set the operation timing of the fuel on the basis of a signal output by a crank angle sensor.

It is still further noted that it is sufficient to indirectly measure intake air flow or intake vacuum pressure by detecting the degree of opening of the throttle valve 4 and rotational speed of the engine.

With this construction, the fuel is injected and supplied in accordance with the operation of each cylinder, whereby the distribution of the fuel between cylinders is made substantially uniform. Thereby, high performance at starting, smoothness in the rotation of the engine, and the improvement in exhaust purity will be expected.

Further, with the above construction, it is possible to maintain the maximum required amount of fuel. Furthermore, it is possible to maintain a long opening time of the valve by lowering the pressure of the fuel being supplied with respect to the small amount of fuel supply in the low intake air flow range. The fuel supply device thus makes it possible to supply the desired amount of fuel with high accuracy.

While the present invention has been particularly shown and described with reference to preferred embodiments thereof, it will be understood by those skilled in the art that the foregoing and other changes in form and details may be made therein without departing from the spirit and scope of the invention.

What is claimed is:

1. A fuel supply control system for a single-point injection internal combustion engine having an intake manifold and including a fuel injection valve connected to a fuel source, an electronic control circuit for controlling opening and closing of said fuel injection valve in accordance with engine driving conditions as detected by sensors for detecting various engine control parameters, and a fuel pressure control means for controlling a fuel pressure of fuel at said fuel injection valve as a function of a vacuum in the intake manifold;

said fuel pressure control means including a vacuum responsive valve means for varying the fuel pressure at the fuel injection valve as a function of engine load, said function varying at a greater rate than the rate of variation of intake vacuum with engine load.

2. A fuel injection control system for a single-point fuel injection internal combustion engine having an intake manifold including a fuel injection valve connected with a fuel source, sensor means for detecting a plurality of engine operating parameters and generating detection signals, control means responsive to said detected signals for determining a fuel injection timing and fuel injection amount, and a fuel pressure control means for varying a fuel pressure at the injection valve according to a vacuum in the intake manifold, said fuel pressure control means comprising a vacuum-responsive member including a valve means having a variable ratio of opened to closed operation, said ratio being a function of the vacuum in the intake manifold, and a set spring for biasing said vacuum responsive member by a predetermined force to control displacement of the vacuum responsive member for a given intake manifold vacuum, said set spring being operable to define said ratio so that fuel pressure at said injection valve varies as a function of the intake manifold vacuum, said function varying at a greater rate than the rate of variation of the intake manifold vacuum with engine load.

3. A fuel injection control system for a single-point fuel injection internal combustion engine having an intake manifold comprising:

a fuel injection valve disposed in an induction passage of said intake manifold;

an actuation means associated with said fuel injection valve for controlling an opening and closing duration of said fuel injection valve to substantially fixed durations;

a vacuum control means responsive to a vacuum in the intake manifold;

a fuel pressure regulator for controlling a pressure of the fuel supplied to the fuel injection valve, said fuel pressure regulator including a means responsive to said intake manifold vacuum for controlling the fuel pressure at the injection valve as a function of said intake manifold vacuum so that a pressure difference between the fuel pressure at the fuel injection valve and intake manifold vacuum corresponds to a load condition on the engine and varies at a rate greater then a rate of variation of said intake manifold vacuum whereby said fuel pressure at the fuel injection valve substantially determines the fuel amount injected per said opening duration of said actuation means.

4. A method for controlling fuel pressure at a fuel injection valve in a single point fuel injection internal combustion engine having a fuel supply system for supplying fuel in a controlled amount in synchronism with a spark ignition effected in the engine, said fuel supply system including a control system for determining a fuel amount to be supplied to an induction passage and for controlling said fuel injection valve, said method comprising:

determining a load condition of the engine; and controlling fuel pressure at said fuel injection valve with a fuel pressure regulator means depending upon said engine load condition whereby the fuel pressure at said fuel injection valve is increased at a rate substantially larger than a determined increasing rate of engine load when engine load is increasing, and whereby a pressure difference between the fuel pressure at said injection valve and intake manifold absolute value is increased when the engine load is increased.

5. A fuel injection control system for an internal combustion engine as defined in claim 4, wherein said pressure regulator controls the fuel pressure within a range from about 0.7 $kg/cm^2$ to about 4 $kg/cm^2$ according to the load condition on the engine.

6. A method for controlling an amount of fuel injected by a fuel injection system of an internal combustion engine having a fuel injection valve controlled in accordance with a duty cycle determined by a fuel injection pulse produced by a controller, said fuel injection valve being controlled to open for injecting fuel for a period corresponding to a fuel injection pulse width, a fuel supply circuit connecting said fuel injection valve to a fuel source, and a pressure regulator in said fuel supply circuit between said fuel injection valve and said fuel source for controlling a pressure of the fuel at said fuel injection valve, said method comprising:

determining a load condition of the engine;

controlling the duty cycle of the fuel injection valve so that the fuel injection valve opens for a substantially constant period regardless of engine load condition; and controlling the fuel pressure at the fuel injection valve responsive to said determined engine load condition whereby the fuel pressure at said fuel injection valve increases at a rate substantially larger than a rate of increase of engine load when the engine load is increasing, so that a pressure difference between the fuel pressure at said fuel injection valve and a pressure portional to the engine load increases when the engine load increases.

7. The method of claim 6 wherein during said low load conditions the fuel pressure is regulated to on the order of about 0.7–0.8 kg/cm$^2$ and during high engine load conditions, the fuel pressure is regulated to on the order of about 4 kg/cm$^2$.

8. A fuel injection control system for an internal combustion engine for controlling a fuel amount supplied to said engine and a fuel pressure of said system, said system comprising:

an electromagnetically actuated fuel injection valve provided in an induction passage of the engine for effecting single point fuel injection;

an engine load sensor for determining a load condition on the engine and producing an engine load signal representative of the determined engine load condition, said engine load signal defining a basic fuel injection pulse width to be applied to said fuel injection valve;

a spark ignition device for effecting spark ignition in synchronism with engine operation, said ignition device outputting a pulse signal upon effecting ignition;

an engine temperature sensor for determining the engine temperature and producing an engine temperature signal indicative of said determined engine temperature;

an intake vacuum sensor for determining a vacuum in an intake manifold of said induction passage and producing a vacuum signal indicative of said determined intake vacuum;

an engine speed sensor for determining engine speed and producing an engine speed signal indicative of said determined engine speed;

a control means responsive to said engine load signal, engine temperature signal, vacuum signal and engine speed signal for determining an actual fuel injection amount and for modifying the basic fuel injection pulse width, said control means being responsive to said ignition pulse signal for controlling fuel injection timing in synchronism with the spark ignition;

a fuel supply circuit interpositioned between said fuel injection valve and a fuel tank; and a pressure regulation means in said fuel supply circuit having a means, responsive to the intake vacuum, for controlling a fuel pressure at said fuel injection valve so that the pressure difference between the fuel pressure at said injection valve and intake vacuum is larger under high engine load conditions than under low engine load conditions and whereby said fuel injection pulse width, even under low engine load conditions, exceeds 2.5 msec.

9. A fuel injection control system for an internal combustion engine having an induction passage for controlling a fuel amount supplied to said engine and a fuel pressure of said system, said system comprising:

an electromagnetically controlled fuel injection valve provided in said induction passage for effecting single point fuel injection;

an engine load sensor for determining a load condition on the engine and producing an engine load signal representative of said determined engine load condition, said engine load signal defining a basic fuel injection pulse width to be applied to said fuel injection valve;

a spark ignition device for effecting spark ignition in synchronism with engine operation, said ignition device outputting a pulse signal upon effecting the ignition;

an engine temperature sensor for determining engine temperature and producing an engine temperature signal indicative of said determined engine temperature;

an intake vacuum sensor for determining vacuum in an intake manifold of said induction passage and producing a vacuum signal indicative of said determined intake vacuum;

an engine speed sensor for determining engine speed and producing an engine speed signal indicative of said determined engine speed;

a control means responsive to said engine load, engine temperature signal, vacuum signal and engine speed signal for determining an actual fuel injection amount, and for modifying said basic fuel injection pulse width accordingly, said control means being responsive to said ignition pulse signal for controlling fuel injection timing in synchronism with the spark ignition;

a fuel supply circuit positioned between said fuel injection valve and a fuel tank; and a pressure regulation means in said fuel supply circuit for controlling the fuel pressure according to the vacuum in the intake manifold and according to engine load conditions such that a pressure difference between a fuel pressure at the injection valve and the pressure at the intake manifold varies as a function of the engine load, said function increasing at a greater rate than a rate of varying of the intake vacuum as a function of engine load.

10. A fuel injection control system for a single-point injection internal combustion engine for controlling a fuel amount supplied to said engine and a fuel pressure of said system, said system comprising:

an electromagnetically controlled fuel injection valve provided in an induction passage of the engine and operable to effect single point fuel injection;

an engine load sensor for determining a load condition on the engine and for producing an engine load signal representative of said determined engine load condition;

a spark ignition device for effecting spark ignition in synchronism with the engine operation, said ignition device outputting a pulse signal upon effecting the ignition;

a control means responsive to said pulse signal for controlling the fuel injection timing in synchronism with the spark ignition;

a fuel supply circuit positioned between said fuel injection valve and a fuel tank, said fuel supply circuit comprising:

a pressure regulation means including a valve operable to open and close in response to an intake vacuum in an intake manifold of said induction passage, and a means for controlling a ratio of opened to closed time durations of said valve in response to variations in said engine load condition, said control means being operable to control a fuel pressure at said fuel injection valve whereby a pressure difference between the fuel pressure at said fuel injection valve and the intake vacuum is greater than a mean value of fuel pressure under high engine operating conditions and the pressure difference between the fuel pressure at said fuel injection valve and the intake vacuum is smaller than said mean value of fuel pressure under low engine operating conditions.

11. A fuel injection control system for an internal combustion engine having an induction passage for controlling the fuel amount supplied to the engine and the fuel pressure of the system, said system comprising:

an electromagnetically actuated fuel injection valve provided in said induction passage for effecting single point fuel injection in response to a variable width fuel injection pulse;

an engine load sensor for determining a load condition of the engine and producing an engine load signal representative of said determined load condition, said load signal defining a basic fuel injection pulse width;

a spark ignition device for effecting spark ignition in synchronism with engine operation, said ignition device outputting pulse signals upon effecting ignition;

an engine temperature sensor for determining engine temperature and producing a temperature signal indicative of said determined temperature;

an intake vacuum sensor for determining a vacuum in an intake manifold of said induction passage and producing a vacuum signal indicative of said determined intake vacuum;

an engine speed sensor for determining engine speed and producing a speed signal indicative of said determined speed;

a control means responsive to said load signal, temperature signal, vacuum signal and speed signal and for determining an actual fuel injection amount and operable to vary said fuel injection pulse width within a relatively narrow range wherein under low engine load conditions, said fuel injection pulse width is relatively large and under high engine load conditions, said fuel injection pulse width is relatively small, said control means being responsive to said pulse signals for controlling the fuel injection pulse timing in synchronism with said ignition;

a fuel supply circuit positioned between said fuel injection valve and fuel tank, said supply circuit comprising:

a pressure regulation means having a means, responsive to the intake vacuum, for controlling a fuel pressure at said injection valve so that the pressure difference between the fuel pressure at the fuel injector valve and intake manifold vacuum is larger under high load conditions than under low load conditions.

12. A fuel injection control system for an internal combustion engine having an induction passage for controlling a fuel amount supplied to the engine and a fuel pressure of an injection system, said system comprising:

an electromagnetically controlled fuel injection valve in said induction passage for effecting single point fuel injection in response to a variable width fuel injection pulse;

an engine load sensor for determining a load condition of the engine and producing an engine load signal representative of said determined load condition, said load signal defining a basic fuel injection pulse width;

a spark ignition device for effecting spark ignition in synchronism with engine operation, said ignition device outputting pulse signals upon effecting ignition;

an engine temperature sensor for determining engine temperature and producing a temperature signal indicative of said engine temperature;

an intake vacuum sensor for determining a vacuum in an intake manifold of said induction passage and producing a vacuum signal indicative of said determined intake vacuum;

an engine speed sensor for determining engine speed and producing a speed signal indicative of said determined speed;

a control means responsive to said load signal, temperature signal, vacuum signal and speed signal to determine an actual fuel injection amount and operable to vary said fuel injection pulse width within a relatively narrow range of variation, said control means being responsive to said pulse signals for controlling the fuel injection timing in synchronism with said spark ignition;

a fuel supply circuit positioned between said fuel injection valve and a fuel tank, said supply circuit comprising:

a pressure regulation means for controlling a fuel pressure at the fuel injection valve responsive to the intake manifold vacuum and the engine load condition and operable to vary a pressure difference between the fuel pressure at the fuel injection valve as a function of engine load at a higher rate than a variation of the intake manifold vacuum as a function of engine load.

13. A fuel injection control system, for a single-point injection internal combustion engine having an induction passage, for controlling the fuel amount supplied to the engine and a fuel pressure of the system, said system comprising:

an electromagnetically controlled fuel injection valve provided in said induction passage for effecting single point fuel injection;

an engine load sensor for determining a load condition of the engine and producing an engine load signal representative of said determined load condition;

a spark ignition device for effecting spark ignition in synchronism with engine operation, said ignition device outputting pulse signals upon effecting ignition;

a control means for producing a substantially constant pulse width fuel injection pulse, said control means being responsive to said pulse signals for controlling the fuel injection timing in synchronism with the ignition;

a fuel supply circuit positioned between said fuel injection valve and the fuel tank, said supply circuit comprising:

a pressure regulation means responsive to the intake vacuum to open and close, and a means for controlling a ratio of open to close time durations of said pressure regulation means according to variations in engine load to control a fuel pressure at the fuel injector valve whereby a pressure difference between the fuel pressure at the fuel injector valve and the intake vacuum is greater under high engine load conditions than under low engine load conditions.

14. The fuel injection control system of one of claims 11 and 13 wherein during said low load conditions the fuel pressure is regulated to on the order of about 0.7–0.8 kg/cm$^2$ and during said high engine load conditions, the fuel pressure is regulated to on the order of about 4 kg/cm$^2$.

15. A fuel supply control system as set forth in claim 8 13, 11 or 12 wherein said system further includes an oxygen sensor for determining the oxygen concentration in the exhaust gas of the engine and producing an oxygen sensor signal representative of said determined oxygen concentration, said control means is responsive to said oxygen sensor signal to correct the fuel injection pulse width corresponding to said oxygen sensor signal value.

16. A fuel supply control system as set forth in claim 8, 9, 10, 11, 12, or 13 wherein said pressure regulation means comprises:

a regulator housing defining therein first and second chambers;

a vacuum responsive diaphragm and a valve member associated with said diaphragm, said diaphragm and valve member being disposed within said first chamber;

means for communicating between said first chamber and a fuel supply circuit, said fuel supply circuit comprising a fuel tank and a fuel pump; and means communicating between said second chamber and said intake manifold, said diaphragm being adjustable to a set pressure defining a pressure of said intake vacuum at which said valve member changes from a first position to a second position.

17. A fuel injection control system for an internal combustion engine having an induction passage comprising:

a fuel injection valve operable to inject a controlled amount of fuel into said induction passage;

a fuel supply line connected to said injection valve;

a pressure regulator means in said fuel supply line responsive to an intake vacuum in said induction passage for regulating a pressure of the fuel at the fuel injection valve, said pressure regulator means controlling the fuel pressure at the fuel injection valve as a function of the engine load wherein said fuel pressure varies at a greater rate than engine load variations so that the pressure difference between the fuel pressure at the fuel injection valve and the absolute pressure of the intake vacuum increases during increasing engine load;

a sensor for detecting an engine operating condition; and a control means for controlling the operation of the fuel injection valve in accordance with the output of the sensor, said control means being operable to produce a fuel injection pulse indicative of a duty cycle of said fuel injection valve and corresponding to a required fuel injection amount determined by said engine operating condition.

18. A fuel injection control system for an internal combustion engine having an induction passage comprising:

a fuel injection valve for injecting a controlled amount of fuel into said induction passage;

a fuel supply line connected to said fuel injection valve;

a pressure regulator means in said fuel supply line responsive to an intake vacuum in said induction passage for regulating a pressure of the fuel to the fuel injection valve, said pressure regulator means being operable to control the fuel pressure at the fuel injection valve as a function of engine load variation and to vary the fuel pressure at the fuel injection valve at a larger rate than a corresponding rate of engine load variation whereby a pressure difference between the fuel pressure at the fuel injection valve and absolute pressure of intake vacuum increases with increasing engine load;

a sensor for detecting an engine operating condition and generating an output indicative of said operating condition;

a control means for controlling the operation of the fuel injection valve to inject a controlled amount of fuel based on said sensor output, said control means producing a variable width fuel injection pulse having a pulse width corresponding to an amount of fuel to be injected based on said fuel pressure variation, said pulse width being variable within a substantially narrow range wherein at low load engine conditions when said fuel pressure at said fuel injection valve is relatively low, the pulse width is relatively large and, at high load conditions when said fuel pressure at said fuel injector valve is relatively high, the pulse width is relatively short.

19. A fuel injection control system for an internal combustion engine as defined in claim 17 or 18 wherein a minimum fuel pressure at the fuel injection valve is on the order of about one fifth to sixth of a maximum pressure.

20. A fuel injection control system for an internal combustion engine as defined in claim 17 or 18, wherein the rotational speed detecting signal is detected on the basis of an ignition firing pulse.

21. A fuel injection control system for an internal combustion engine as defined in claim 17 or 18, wherein said pressure regulator means comprises:

a regulator housing;

a vacuum responsive diaphragm disposed within said regulator housing and defining therein first and second chambers;

a valve member associated with said diaphragm and disposed within said first chamber, said valve member being movable between an open position and a closed position;

a fuel inlet nozzle, one end of which communicates with a fuel pump, an other end of which communicates with said first chamber;

a fuel outlet nozzle provided in the first chamber, one end of which communicates with a fuel return passage, an other end of which is operable to contact said valve member, and a stem connecting said valve member and said diaphragm;

a compression spring disposed within said second chamber for providing a set pressure on the valve member; and a vacuum pressure nozzle in the second chamber which communicates with the intake manifold.

22. A fuel injection control system for an internal combustion engine as defined in claim 21, wherein said valve member has a cross sectional area smaller than that of the diaphragm.

23. A fuel injection control system for an internal combustion engine as defined in claim 17 or 18, wherein said control means comprises; an intake air flow detecting circuit responsive to the output of an air flow meter, a vacuum pressure detecting circuit responsive to the output of an intake vacuum pressure sensor, a driving pulse width calculating circuit producing a driving pulse responsive to the outputs of the intake air flow detecting circuit and the vacuum pressure detecting circuit, a timing circuit for determing the timing of the fuel injection responsive to a sensor for detecting the operation of each cylinder, and a fuel injection valve driving circuit responsive to the driving pulse and the output of the timing circuit to render the fuel injection valve operative.

24. A fuel injection control system for an internal combustion as defined in claim 23, wherein said control means further comprises an oxygen concentration detecting circuit responsive to the output of an oxygen sensor, whereby a correction is made to the output of the intake air flow detecting circuit according to the output of the said oxygen concentration detecting circuit.

25. A fuel injection control system for an internal combustion engine as defined in claim 17, wherein said control means comprises an intake vacuum pressure detecting circuit responsive to an output of an intake vacuum pressure sensor, a rotational speed detector for detecting the rotational speed of the engine, a timing circuit for detecting the timing of the fuel injection, a driving pulse width calculating circuit responsive to the outputs of the intake vacuum pressure detecting circuit and the rotational speed detector to produce a driving pulse, thereby rendering the fuel injection valve driving circuit operative to actuate the fuel injection valve.

26. A fuel injection control system for an internal combustion engine as defined in claim 23 or 25, which further comprises a water temperature detecting circuit responsive to the output of a water temperature sensor, a decision circuit producing an output when the output of the water temperature detecting circuit is above the predetermined value, a switching circuit responsive to the output of the decision circuit, an electromagnetic valve driving circuit responsive to the output of the switching circuit to actuate a magnetic valve provided in a vacuum pressure conduit disposed between an intake manifold and the vacuum pressure conduit nozzle.

* * * * *